United States Patent [19]

Goss

[11] 4,406,064

[45] Sep. 27, 1983

[54] GRAVITY STABILIZED PORTABLE POWER TOOL HANGER

[76] Inventor: Duke W. Goss, 2560 116th Ave. NE., Bellevue, Wash. 98004

[21] Appl. No.: 273,756

[22] Filed: Jun. 15, 1981

[51] Int. Cl.[3] ..... B27B 9/00

[52] U.S. Cl. ..... 30/296 A; 30/340; 30/390

[58] Field of Search ..... 30/166 R, 166 A, 296 R, 30/296 A, 371, 372, 373, 391, 388, 389, 390, 231, 340, 377; 145/35 R

[56] References Cited

U.S. PATENT DOCUMENTS

| | | | |
|---|---|---|---|
| 869,947 | 11/1907 | Tupper . | |
| 1,116,847 | 11/1914 | Russell . | |
| 1,303,908 | 5/1919 | Johnson . | |
| 1,948,932 | 2/1934 | McMickle | 65/65 |
| 2,262,832 | 11/1941 | Caldwell | 145/35 |
| 2,309,990 | 2/1943 | Savi | 248/360 |
| 2,467,905 | 4/1949 | Ostberg | 248/360 |
| 2,730,803 | 1/1956 | Kimball | 30/167 |
| 2,841,192 | 7/1958 | Martin | 30/340 X |
| 3,886,658 | 6/1975 | Wikoff | 30/388 |
| 4,179,805 | 12/1979 | Yamada | 30/122 |

FOREIGN PATENT DOCUMENTS 688661 3/1953 United Kingdom .

*Primary Examiner*—Jimmy C. Peters

*Attorney, Agent, or Firm*—Delbert J. Barnard

[57] ABSTRACT

A hanger for a portable power tool and the combination of the hanger and the tool. The hanger is secured to the tool handle along a wall thereof by a screw or screws which extends through a screw hole or holes provided to receive a screw or screws, respectively, to secure the handle to the tool housing. A wall of the hanger is contiguous or substantially contiguous with the wall of the handle. The screw holding the hanger to the handle and housing extends transversely to elongated directions of the contiguous walls and extends intermediate the wall ends. A channel is secured to the hanger and has its side walls extending over the above walls and along side walls of the handle, the screw extending through the side walls. This arrangement prevents pivoting of the handle with respect to the screw and handle, and securely fixes the hanger to the handle with respect to external forces on the hanger.

5 Claims, 8 Drawing Figures

Fig. 1
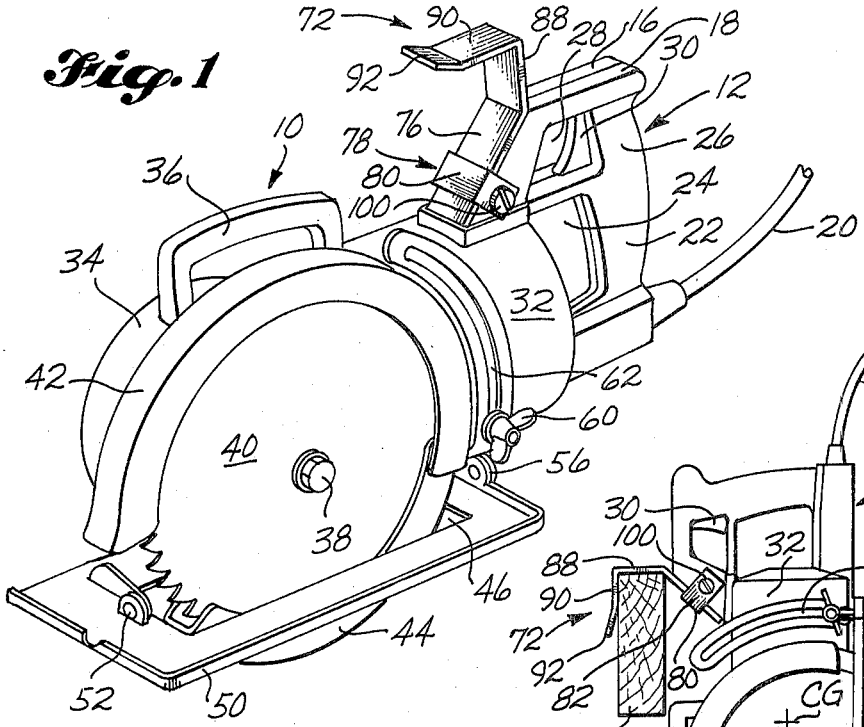
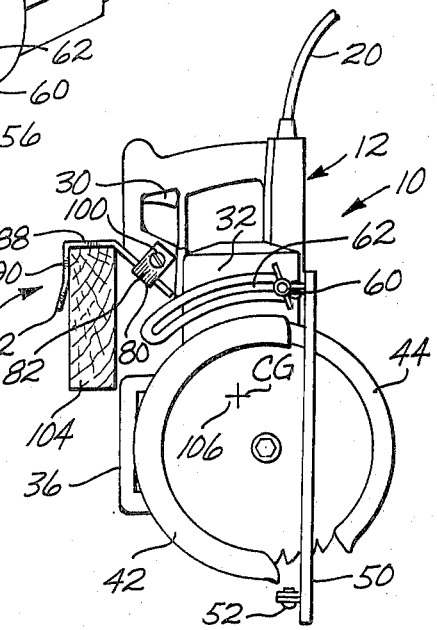
Fig. 2
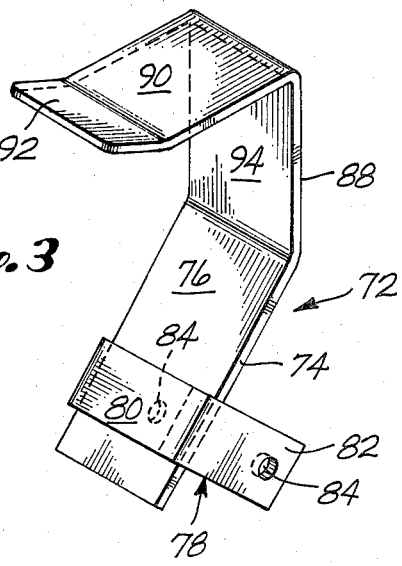
Fig. 3
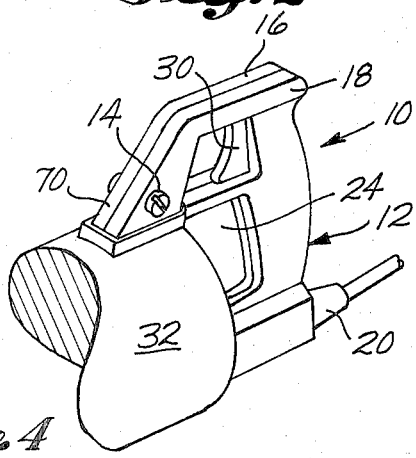
Fig. 4

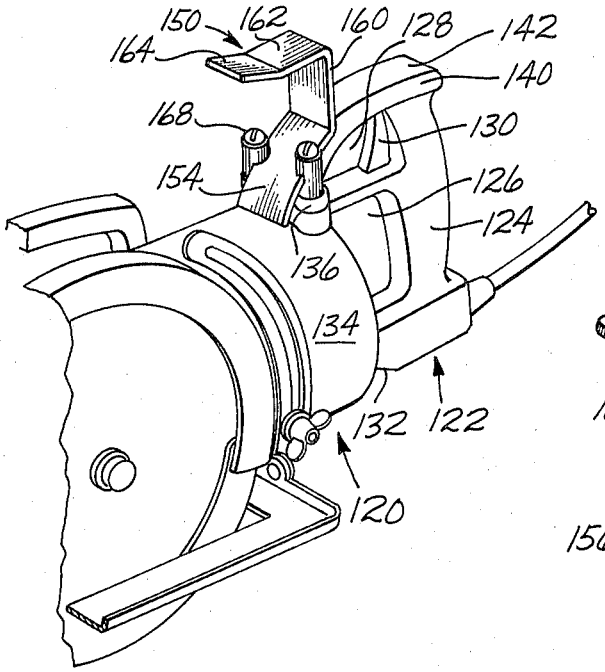
Fig. 6
Fig. 5
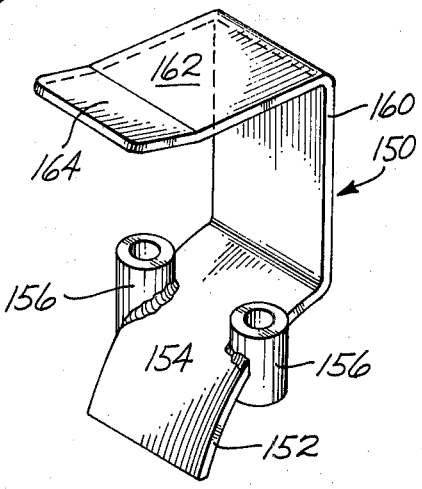
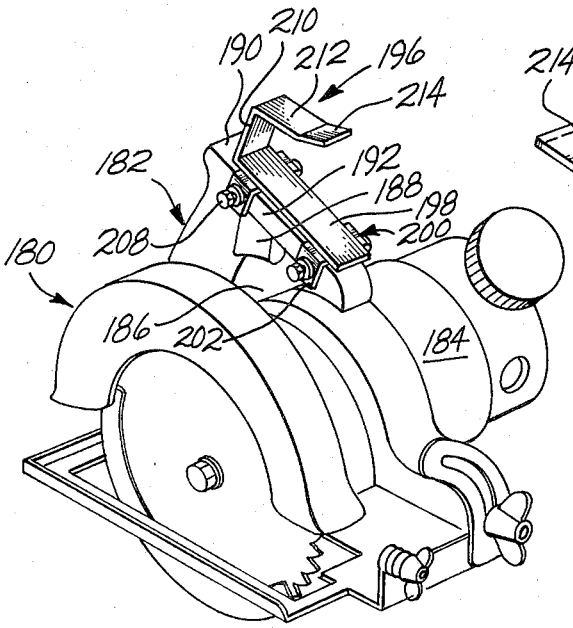
Fig. 8
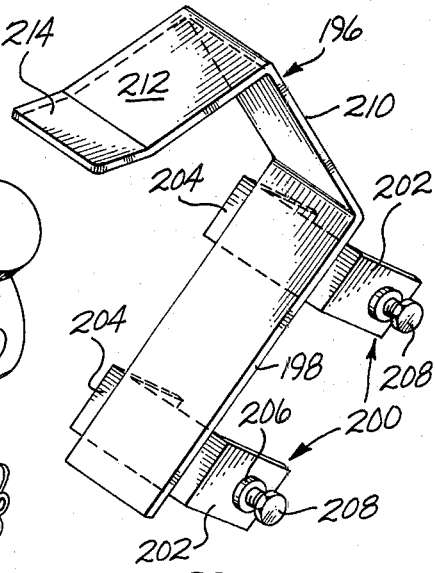
Fig. 7

GRAVITY STABILIZED PORTABLE POWER TOOL HANGER

DESCRIPTION

1. Technical Field

The invention relates to hangers for use on portable power tools such as electric saws, for example. Frequently, environmental conditions for operation are such that the tools must be supported in working areas where flat surfaces are not available and hanging means must be provided.

2. Background Art

In wooden frame construction, for example, portable power tools such as electric saws are carried and operated in locations where there are no table-like supports. Thus, an operator must look to other means for supporting a tool when it is not in use. Frequently a carpenter, for example, is working on joists where there are no floor supports and there is a need for structure on a portable saw for hanging the same on a joist. The known portable saws have no hangers, for example, by which saws can be conveniently and safely hung in such situations.

A search of the patent literature discloses a number of tools which have hangers but none of which provide a satisfactory solution for the hanging of a portable electric saw. For example, U.S. Pat. No. 869,947 to Tupper shows a hand saw hanging device which clearly is not adequate to support a portable electric saw securely. A similar type of hanging device is suggested in U.S. Pat. No. 2,262,832 to Caldwell but it also would be inadequate for a relatively heavy, modern, power driven tool.

The following patents disclose various devices and systems for supporting tools but none are suggestive of solving the problems involved with the type of tools in question:

U.S. Pat. Nos. 1,303,908 Johnson, 2,309,990 Savi, 3,886,658 Wikoff, 4,179,805 Yamada, 2,730,803 Kimball, 1,948,932 McMickle, 2,467,905 Ostberg, 1,116,847 Russell, British Pat. No. 688,661 Baier.

DISCLOSURE OF THE INVENTION

The invention is a hanger adapted to gravity stabilize a portable power tool such as an electric saw, and the combination of the hanger and the saw.

In a typical portable tool, a handle is secured to the body of the tool by means of one or more screws or bolts extending through the handle and extending through a part of the body whereby the handle, which may be in two parts, is secured to the body.

According to the invention, a wall of the hanger is secured along a wall of the tool handle so that the walls are contiguous or substantially contiguous. The two walls are so secured through a screw hole through which the handle is secured to the tool. The screw or bolt used to secure the hanger is positioned in the same hole as used in the handle but the screw or bolt usually has to be of a greater length to hold the hanger to the handle than the original screw.

When only one screw is used to secure the hanger to the handle, the screw is typically spaced from the wall of the handle on which the wall of the hanger is to be substantially contiguously positioned. In such a situation, the distance between the screw and the outer portion of the hanger, or the shorter distance between the screw and the handle wall, provides a moment arm which would tend to weaken the holding of the hanger on the handle, so that any substantial force that would tend to rotate the hanger on the screw could relatively, easily break the hanger from the handle. In typical construction work, the force on a hanging tool, including the weight of the tool itself, could be sufficient to tend to pivot the hanger on the single screw.

In one embodiment this problem is overcome by using the position of the screw, which is intermediate the ends of the handle wall on which the hanger is to be positioned. The hanger wall is thus made of a length so as to extend along the handle wall, and it is fitted on the handle wall so as to be contiguous or substantially contiguous therewith, both walls being elongated so that the screw and any structure attached thereto for holding the walls together are intermediate the ends of the walls. Thus, there is provision against rotation of the structure on the screw. The attaching structure is an inverted channel held in place through its channel legs by the screw, and the channel base abuts and is secured to the hanger wall. Both ends of each of the walls extend beyond the channel so that walls are held together by the channel with no rotational movement with respect to the screw.

In another embodiment of the invention, there are two screws, having their centers in the same plane, securing the handle to the body of the tool. In this particular embodiment, the surface of the handle between the screws, and extending in the elongated direction between the screws and beyond, is curved so that the wall of the hanger, according to the invention, is also curved so as to be substantially contiguous with the handle wall. Sleeves are secured on opposite edges of the hanger, having their centers in the same plane, and being adapted to receive screws to secure both the hanger and the handle to the tool. By securing the hanger and handle in the same plane and having the walls of the hanger and the handle being contiguous in an elongated direction on both sides of the plane, the possibility of rotating the hanger with respect to the plane so as to dislodge it from the handle, by any force which it may encounter, is extremely remote.

In a third embodiment of the invention, a hanger wall is secured to a handle wall by means of two spaced channel-shaped members extending over the handle and secured in place by set screws through the legs of the channels. The channel members have their surface opposite the channel bottom secured to the wall of the hanger. In this embodiment, the securing of the hanger to the handle by the spaced set screws removes the problem of the development of possible rotation around a single holding point.

In each of the embodiments, there is a non-contiguous wall on the hanger extending outwardly from the wall that is contiguous with the handle wall. The non-contiguous wall normally provides the primary hanger support wall for the tool. It is typically supportable on the edge of a joist, for example, or could be supported on a rod or a sufficiently sturdy nail, for example.

There is a third hanger wall, extending from the non-contiguous wall, and it is adapted to extend downwardly when the non-contiguous wall is generally horizontal so as to support the tool.

In a typical arrangement, the center of gravity of the tool is such so as to swing the tool toward a joist when the hanger is supporting the tool thereon. This makes for a secure hanging arrangement.

Further advantages of the invention may be brought out in the following part of the specification wherein small details have been described for the competence of the disclosure, without intending to limit the scope of the invention which is set forth in the appended claims.

BRIEF DESCRIPTION OF THE DRAWINGS

Referring to the accompanying drawings which are for illustrative purposes:

FIG. 1 is a pictorial view of a portable electrically driven saw having a hanger according to the invention, secured to a handle of the saw;

FIG. 2 is side elevational view of the portable saw shown in FIG. 1, hanging on a joist by a hanger according to the invention;

FIG. 3 is a pictorial view of the hanger separated from the tool;

FIG. 4 is a fragmentary pictorial view of the saw shown in FIG. 1 but without the hanger attached to illustrate the position of the screw used to secure the handle to the body of the tool;

FIG. 5 is a pictorial view of a hanger according to another embodiment of the invention;

FIG. 6 is a fragmentary view of an electric portable saw to which the hanger shown in FIG. 5 is attached;

FIG. 7 is a pictorial view of a hanger illustrating a third embodiment of the hanger; and FIG. 8 is a pictorial view of a portable electrically driven saw on which the hanger in FIG. 7 is attached along a wall of a handle with which the tool is controlled and operated.

BEST MODE FOR CARRYING OUT THE INVENTION

Referring again to the drawings, there is shown in FIGS. 1, 2 and 4, a portable electrically driven saw, generally designated as 10, having a two part operating handle, generally designated as 12, the two parts 16 and 18 being secured together by a plurality of screws or bolts or other means including a screw 14, shown in FIG. 4. The two parts 16 and 18, having generally flat abuting surfaces, not shown, have an opening at their lower rear through which they receive an electrical power supplying lead 20. The handle has a lower gripping portion 22, having an opening 24 for an operator's three fingers and has an upper gripping portion 26, having an opening 28 to receive the operator's forefinger which is adapted to control a trigger switch 30 normally spring biased into an off position.

The handle 12 is secured to a saw body 32, by means not shown, and by the screw 14 through the handle and through an ear portion extending into the handle and having an opening to receive the screw 14 in a holding relationship. Secured to the body 32, housing an electric motor, is a gear box portion 34 from which extends a guiding handle 36. The gear box contains a saw driving shaft 38 on which a rotary saw 40 is mounted. The upper portion of the saw is covered by a fixed guard 42 and the lower portion is covered by a rotatable spring-biased guard 44. The blade 40 and the guard 44 extend through a generally rectangular opening 46 in a supporting guide plate 50, secured for tilting adjustment at 52 and 56, and secured for rotation by a wing nut 60 in an arcuate slot 62. The forward end of the blade 40 is exposed between the two guards 42 and 44 and inwardly of the support 50.

The handle, FIG. 4, has an elongated forward flat wall 70, formed on the two handle parts 16 and 18, and adapted to receive a hanger, generally designated as 72, FIG. 3, according to the invention. The hanger has an elongated wall 74, complementary to the wall 70, the walls both being flat so as to be contiguous, FIGS. 1, 3. Extending transversely over a top face 76, of the wall, is a channel, generally designated as 78, having a base 80 and a pair of generally parallel side walls 82. The bottom of the base 80 is welded to the surface 76 and the side walls extend over the edges of the wall 74. Channel legs have transversely aligned screw holes 84 extending therethrough so as to be in alignment with the hole containing the screw 14, FIG. 4, when positioned so that the wall 74 is contiguous with the wall 70.

A second or non-contiguous wall 88 extends outwardly from the wall 74 at an obtuse angle and a third wall 90 extends from the wall 88 so as to be substantially at a right angle thereto. The wall 90 is relieved at its outer or lower end 92 so as to more easily be positioned onto a support. When so positioned, the primary supporting surface of the hanger is normally along the surface 94 of the wall 88.

In the embodiment shown in FIG. 1, the screw 14 is removed when the hanger 72 is installed, and a longer screw or bolt is inserted through the opening of the screw 14 and through the aligned openings 84 in the channel 78. The longer screw 100 may have a nut on one end and a head on the other, or may be tightened and threaded through openings 84, or may be in the form of two aligned screws, one entering each end of the channel and threadedly engaged through the channel openings, as well as the openings in the handle.

The arrangement, FIGS. 1 and 2, of the two walls 70 and 74 with the channel 78 intermediate their ends provides a secure fitting of the hanger to the handle by means of the single transverse screw or bolt 100 through the channel legs 82 and the handle. In this structure, the development of a moment arm between the screw center line and the wall 76, or any part of the hanger outwardly thereof, by forces acting on the hanger is eliminated by the extension of the contiguous walls beyond the channel. That is, by having the channel intermediate the ends of the walls, a tendency to develop rotation around what would become a pivot in the screw hole is eliminated and no moment action on the hanger walls outwardly from the hole can occur. Thus, a very secure hanger 72 is fixed on the handle wall 70 through a screw hole provided in the original handle by means of a single screw or bolt.

As shown in FIG. 2, the hanger 72 is positioned over the edge of a standard joist 104 so as to support the tool in a downwardly hanging, substantially parallel position with respect to the joist. The handle surface 94 rests on the top of the joist, and in this position, the center of gravity of the tool 10, shown to be at the cross 106, causes the tool to swing toward the joist with the handle 36 in substantial contact therewith and in a position to prevent further swinging beyond the joist. This makes for a safe hanging arrangement and holds the tool in a substantially rigid position with respect to the hanger on the joist.

In FIG. 6 there is a portable electric saw generally designated as 120, similar to that shown in FIG. 1 and having a handle, generally designated as 122. The handle has a lower portion 124 with an opening 126 to receive the lower three fingers and an opening 128 to receive the forefinger to actuate a trigger switch 130. The hanger is secured at its lower end 132 to the body 134 of the saw by means not shown.

At the upper end, the handle without a hanger, would be secured to the upper portion of the body by screws with their heads at the upper surfaces 136 on both sides of the handle wall 140 and a surface 142 therebetween.

A hanger 150, FIG. 5, has a wall 152 with an upper surface 154 with parallel sleeves 156 secured thereto. The sleeves are adapted to be in a plane common to the plane of the screws holding the handle to the tool. The wall 152 is curved to be complementary to the surface of the wall 142 on the handle so that the two surfaces can be put together to be contiguous or substantially contiguous. Both of the walls 152 and 142 are elongated so that the screws extending through the handle support and through the sleeves on the hanger are intermediate the ends of the respective walls.

Extending at a slight obtuse angle to the wall 152 is a primary support or non-contiguous wall 160, and extending generally right angles therefrom is a third wall 162 on the hanger. The hanger wall 162 is relieved outwardly at 164 for ease of engaging on a hanging support such as a joist.

When the sleeves 156 are alligned with the screw holes in the handle, longer screws 168 are inserted into the sleeves and into the threaded holes in the handle so as to secure the hanger to the handle. In this embodiment, the centers of the screws are in a plane transverse to the elongated direction of the walls 152 and 142 and which is intermediate the ends of the walls so as to eliminate the development of a moment by forces acting on the hanger. That is, by having the walls 152 and 154 contiguous and supported between their respective ends, there is little or no opportunity for movement of the hanger with respect to the handle. This again makes for a secure structural arrangement between the hanger and the handle. When the hanger is supported on a joist, such as 104 in FIG. 2, the saw hangs in a way similar to that of saw 10.

In FIG. 8 there is shown a portable power driven saw, generally designated as 180. This type of saw could be electrically or gasoline engine driven. It has its handle 182 secured to a cylindrical saw body 184 by means not shown. The handle has an opening 186 for the fingers and has a trigger switch 188 to be operated by the forefinger. The handle has an upper wall 190 which is substantially flat and has side walls 192 extending downwardly therefrom, substantially at right angles thereto.

In FIG. 7, a hanger 196 is illustrated. The hanger has an elongated flat wall 198, adapted to be complementary to the handle wall 190. Secured to the under side of the wall 198 are a pair of spaced downwardly directed channels 200. The channels have parallel side walls 202 and have their outer base surfaces 204 secured to the under side of the wall 198. Each of the channel walls 202, has tapped bores with welded tapped washers 206 to provide threaded extensions for set screws 208, having pointed inner ends, not shown, to penetrate the opposite walls on the handles.

Extending upwardly from the wall 198, at an obtuse angle thereto, is a primary support wall 210 and extending therefrom at a substantial right angle is a third wall 212, having an outwardly relieved end portion 214.

The hanger 196 is secured to the handle 190 by positioning the wall 198 generally parallel and adjacent the wall 190 with the inner sides of the channel side walls adjacent the side walls 192 on the handle. The set screws 208 are tightened so that their inner pointed ends penetrate the handle and securely engage the hanger thereto. In this arrangement, the hanger is held to the handle through two transverse parallel lines through the set screws which are spaced intermediate the ends of the walls 198 and 190 in the elongated direction. This arrangement prevents any rotation of the handle on either of the screws 208 so as to securely hold the hanger on the handle. The hanger 196, hangs on a joist as shown in FIG. 2, with the inner surface of the wall 210 bearing the primary load contact.

The invention and its attendant advantages will be understood from the foregoing description and it will be apparent that various changes may be made in the form, constuction, and arrangements of the parts of the invention without departing from the spirit and scope thereof or sacrificing its materials, the arrangements hereinbefore described being merely by way of example. I do not wish to be restricted to the specific forms shown or uses mentioned except as defined in the accompanying claims.

I claim:

1. A hanger for use with a portable power tool of a type comprising a housing including detachable housing parts having cooperating screw fastener openings for receiving removable screw means which engage and hold together the housing parts, a handle, finger operated control means adjacent the handle, a first housing surface portion located adjacent the screw fastener openings, and a second housing surface portion spaced from the screw fastener openings and said first housing surface portion, said screw fastener openings, said first housing surface portion and said second housing surface portion all being offset to one side of the tool handle and the center of gravity of the tool, said hanger comprising:

a hook portion adapted to be hooked over a support member, a mounting portion comprising a brace member adapted to fit against the first housing surface portion on the tool, and connector means intermediate the ends of the mounting portion including screw fastener receiving openings which are alignable with the screw fastener openings in the housing parts, so that a screw fastener means used for securing the two housing parts together can also be used for connecting the hanger to the power tool, with said mounting portion including brace parts positioned to extend along said first housing surface portion in opposite directions from the location of the screw fastener receiving openings, to contact the first housing surface portion and brace against rotation of the hanger about the screw fastener means relative to the power tool.

2. A hanger according to claim 1, wherein said hook portion includes a sidewall spaced from the mounting portion of said hanger, and a top wall which is interconnected between said sidewall and the mounting portion of the hanger, to form a hook throat opening away from the handle.

3. A hanger according to claim 2, for use with a power tool of a type in which the cooperating screw fastener openings in the detachable housing parts extend laterally of the tool, and said connector means comprises a pair of sidewalls projecting from the brace member in a direction opposite to the direction in which the hook extends, with the screw fastener receiving openings in said connector means being formed in said sidewalls.

4. A hanger according to claim 1, for use with a power tool of a type comprising screw fastener openings which extend generally normal to first housing surface portion.

5. A hanger according to claim 4, said connector means comprising a pair of laterally spaced apart sleeves, connected to intermediate side portions of the brace member, said screw fastener openings extending axially through said sleeves.

* * * * *